United States Patent [19]

Matthews

[11] 4,313,272

[45] Feb. 2, 1982

[54] LASER BEAM FIREARM AIM ASSISTING METHODS AND APPARATUS

[75] Inventor: John W. Matthews, Fountain Valley, Calif.

[73] Assignee: Laser Products Corporation, Fountain Valley, Calif.

[21] Appl. No.: 33,284

[22] Filed: Apr. 25, 1979

[51] Int. Cl.[3] ..... F41G 1/34

[52] U.S. Cl. ..... 42/1 A

[58] Field of Search ..... 42/1 A, 84, 1 ST; 362/110, 113; 33/245, 247–250

[56] References Cited

U.S. PATENT DOCUMENTS

| | | | |
|---|---|---|---|
| 870,272 | 11/1907 | Burton | 42/1 ST |
| 894,306 | 7/1908 | Wright | 362/110 |
| 1,452,651 | 4/1923 | Norrlin | 42/1 A |
| 1,641,019 | 8/1927 | Woods | 42/1 ST |
| 1,826,004 | 10/1931 | Key | 362/110 |
| 2,017,585 | 10/1935 | Casey . | |
| 2,510,289 | 6/1950 | Livermore | 42/1 ST |
| 2,597,466 | 5/1952 | Felix | 42/1 ST |
| 2,660,794 | 12/1953 | Goertz et al. | 33/49 |
| 2,664,797 | 1/1954 | Thrasher . | |
| 2,693,031 | 11/1954 | Clark | 33/49 |
| 2,844,710 | 7/1958 | Zinsser | 42/1 A |
| 3,010,019 | 11/1961 | Sohst | 250/83.3 |
| 3,153,856 | 10/1964 | Felix | 42/1 ST |
| 3,294,401 | 12/1966 | Nicholas et al. | 273/101.1 |
| 3,506,330 | 4/1970 | Allen | 350/10 |
| 3,508,833 | 4/1970 | Waldhaver, Jr. | 356/152 |
| 3,533,700 | 10/1970 | Alexander | 356/138 |
| 3,619,069 | 11/1971 | Alexander | 356/138 |
| 3,633,285 | 1/1972 | Sensney | 33/25 |
| 3,667,849 | 6/1972 | Appler et al. | 356/152 |
| 3,782,832 | 1/1974 | Hacskaylo | 356/153 |
| 3,796,496 | 3/1974 | Appler et al. | 356/138 |
| 3,823,313 | 7/1974 | Unema | 33/275 R |
| 3,867,764 | 2/1975 | Dunmire et al. | 42/1 A |
| 3,898,747 | 8/1975 | Marshall | 35/25 |
| 3,904,204 | 9/1975 | Yokoi | 273/101.1 |
| 3,938,262 | 2/1976 | Dye et al. | 35/25 |
| 3,962,795 | 6/1976 | Ross | 33/248 |
| 3,974,585 | 8/1976 | Dunham | 42/1 S |
| 3,995,376 | 12/1976 | Kimble et al. | 35/25 |
| 4,026,054 | 5/1977 | Snyder | 42/1 A |
| 4,079,534 | 3/1978 | Snyder | 42/1 A |
| 4,152,754 | 5/1979 | deFilippis et al. | 42/1 A |
| 4,161,076 | 7/1979 | Snyder | 42/1 A |
| 4,161,835 | 7/1979 | Lough | 362/110 |
| 4,168,588 | 9/1979 | Snyder | 42/1 A |
| 4,212,109 | 7/1980 | Snyder | 42/1 A |
| 4,244, 131 | 1/1981 | Kaelin | 42/1 A |

FOREIGN PATENT DOCUMENTS

| | | | |
|---|---|---|---|
| 20195 | 3/1972 | Australia . | |
| 1926337 | 11/1970 | Fed. Rep. of Germany . | |
| 492773 | 4/1919 | France | 42/1 A |
| 1015421 | 7/1952 | France | 42/1 A |
| 29708 | 11/1903 | Switzerland . | |
| 66753 | 12/1913 | Switzerland . | |
| 5029 | 1/1913 | United Kingdom . | |

OTHER PUBLICATIONS

Jenkins et al.; Fundamentals of Optics, 3rd Edition, 1957, pp. 23, 24, FIG. 2L (b)(c).

*Primary Examiner*—Charles T. Jordan
*Attorney, Agent, or Firm*—Benoit Law Corporation

[57] ABSTRACT

A laser for assisting the aiming of a firearm is located in a tubular member for emission of a light beam through an end thereof. The tubular member is mounted at the first location with linear freedom of movement, and at a second location with angular freedom of movement, relative to the firearm. The laser may be potted or rigidly mounted in the tubular member. A relative position of an aiming mark in the form of a light spot on a target of the firearm may be varied by angular adjustment of the tubular member at the first mounting location or by selectively deflecting the light beam in or at the tubular member.

85 Claims, 4 Drawing Figures

LASER BEAM FIREARM AIM ASSISTING METHODS AND APPARATUS

BACKGROUND OF THE INVENTION

1. Field of the Invention

The subject invention relates to firearms and laser systems and, more specifically, to methods and apparatus for assisting the aiming of a firearm, and in particular to methods and apparatus for assisting the aiming of a firearm with a light beam from a laser.

2. Disclosure Statement

This disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness, and inasmuch as a growing attitude appears to require citation of material which might lead to a discovery of pertinent material.

For over seventy years, proposals have been made for assisting the aiming of firearms with light beams or light spots on targets. Reference may, for instance, be had to U.S. Pat. No. 894,306, which proposes clamping of an elongate light source, including a small electric incandescent lamp and a projection lens, to the barrel of a handgun, U.S. Pat. No. 1,452,651, which proposes clamping of a flashlight to a handgun barrel, U.S. Pat. Nos. 1,826,004 and 2,844,710 which propose clamping of an electric incandescent lamp and battery unit to a handgun, and U.S. Pat. Nos. 3,010,019 and 3,974,585 which also propose employment of electric incandescent lamps for providing aiming marks on firearm targets or on an optical sight.

Practical limitations on light output intensity and coherence achievable with incandescent lamps have relegated the utility of such proposals to nightsight or target finder equipment of rather limited range.

Aim assistance electric incandescent lamps also have found a limited application in reticle image projectors of complex computing sights, as may be seen from U.S. Pat. Nos. 2,660,794 and 2,693,031. Apart from such special applications, the use of electric incandescent light aiming assists for firearms appears to have become restricted to aim assessment apparatus, as seen in U.S. Pat. No. 3,508,833.

Further proposals were spawned by the development of laser diodes comparable in size and ruggedness to small incandescent light bulbs (see U.S. Pat. No. 3,867,764). The utility of laser diodes as aiming devices was, however, generally limited to marksmanship trainer, boresight alignment, weapon simulator and similar applications, as may, for instance, be seen from U.S. Pat. Nos. 3,633,285, 3,782,832, 3,898,747, 3,938,262 and 3,995,376.

The success of gas discharge lasers in the surveying instrument field illustrated, for instance, by U.S. Pat. Nos. 3,533,700, 3,619,069, 3,667,849 and 3,823,313, similarly spawned proposals to use that type of laser in weapon aiming systems. As apparent from U.S. Pat. No. 4,026,054, an early proposal of this type structured a laser aiming system in the manner of firearm telescope sights, seen, for instance, in U.S. Pat. Nos. 870,272, 1,641,019, 2,510,289, 2,597,466 and 3,153,856, and also in French Pat. No. 492.773 by Albert Amigues and Louis Huet, issued Apr. 2, 1919.

A subsequent proposal, apparent from U.S. Pat. No. 4,079,534, suggested housing of the laser tube in a sighting apparatus attachment for firearms. Unlike shooting simulation systems having a laser mounted on a stationary support (see U.S. Pat. No. 3,904,204), proposals which suggested attachment of a laser tube to the firearm manifested a serious concern that the laser aiming system would be rendered useless by recoil forces resulting, for instance, in a misalignment of laser cavity end mirrors or breakage of the laser tube. Accordingly, proposals such as shown in the above mentioned U.S. Pat. Nos. 4,026,054 and 4,079,534 suggested the use of heavy shock mounting structures employing a laser head carriage slidable on a guide track, biased by compression springs and cushioned by a pneumatic buffer device. In practice, such a mounting structure considerably increases the bulk and expense of the particular weapons, while exposing same to a need for increased maintenance and danger of aiming inaccuracy.

In the transit instrument field, it has been proposed, as apparent from U.S. Pat. No. 3,796,496, that a laser plummet level unit be securely bolted down and that the flow of current to its laser tube be interrupted in response to undue physical disturbance of the instrument which might disturb the direction of the laser beam. Of course, such a proposal would not be practical with weapon aiming systems, since they would expose the user of the weapon to the danger of loosing sight of the target. Also impractical would be the provision of a gaseous discharge flash tube directly behind the barrel of a firearm, as was proposed in U.S. Pat. No. 3,294,401 for target game purposes.

In consequence, the development of laser aiming systems for firearms became stagnated in a search for effective shock mounting systems.

SUMMARY OF THE INVENTION

It is a general object of this invention to overcome disadvantages and satisfy needs expressed or implicit in the disclosure statement herein set forth.

It is a related object of this invention to provide improved firearms and weapon systems.

It is a germane object of this invention to provide improved laser aiming systems for firearms.

It is a related object of this invention to provide improved methods and apparatus for assisting the aiming of a firearm with a light beam from a laser.

It is a germane object of this invention to provide improved methods and apparatus for providing aiming marks for firearms and weapon systems.

It is also an object of this invention to provide improved laser mounting systems and structures.

Other objects will become apparent in the further course of this disclosure.

From a first aspect thereof, the subject invention resides in a method of assisting the aiming of a firearm with a light beam from a laser and, more specifically, resides in the improvement comprising in combination the steps of locating the laser in a tubular member for emission of the light beam through an end of the tubular member, mounting said tubular member at a first location with linear freedom of movement relative to the firearm, and mounting the tubular member at a second location with angular freedom of movement relative to the firearm.

From another aspect thereof, the subject invention resides in apparatus for assisting the aiming of a firearm and, more specifically, resides in the improvement comprising, in combination, a tubular member, means for providing an aiming mark on a target of the firearm including a laser mounted in the tubular member for emitting a light beam through an end of the tubular member, means for mounting the tubular member on the firearm at a first location, including means for providing the tubular member with linear freedom of movement relative to the firearm, and means for mounting the tubular member on the firearm at a second location, including means for providing the tubular member with angular freedom of movement relative to the firearm.

From another aspect thereof, the subject invention resides in apparatus for assisting the aiming of a firearm and, more specifically, resides in the improvement comprising, in combination, means for providing an aiming mark in the form of a light spot on the target, including a laser device for emitting a laser beam to the target, means including a tubular member for housing the laser device, and means for mounting the tubular member on the firearm, including first means on the tubular member having a surface curved at a radius in a plane intersecting the firearm and the tubular member longitudinally, and second means engaging the first means at a surface complementary to the curved surface, and means for coupling the second means to the firearm.

BRIEF DESCRIPTION OF THE DRAWINGS

The subject invention and its various objects and aspects will become more readily apparent from the following detailed description of preferred embodiments thereof, illustrated by way of example in the accompanying drawings, in which like reference numerals designate like or functionally equivalent parts, and in which.

DESCRIPTION OF PREFERRED EMBODIMENTS

The fear that night sight equipment for firearms could be damaged by recoil or shock has already resulted in special mounting equipment half a century ago, as may be seen from the above mentioned U.S. Pat. No. 1,826,004. This fear has been inherited by contemporary designers of laser beam aiming assistance equipment, as has been noted above in the disclosure statement hereof, leading to complex, bulky and expensive shock mounting apparatus.

The subject invention represents a radical departure from this engrained prejudice in the art, and as a result provides powerful laser beam aiming assistance methods and equipment characterized by high accuracy and reliability coupled with relatively low weight and bulk and high ruggedness.

The laser beam aiming assistance equipment 10 according to the illustrated preferred embodiment of the subject invention may be mounted on and used in conjunction with a basically conventional firearm 12, such as a Colt double action revolver.

Figures 1, 2:
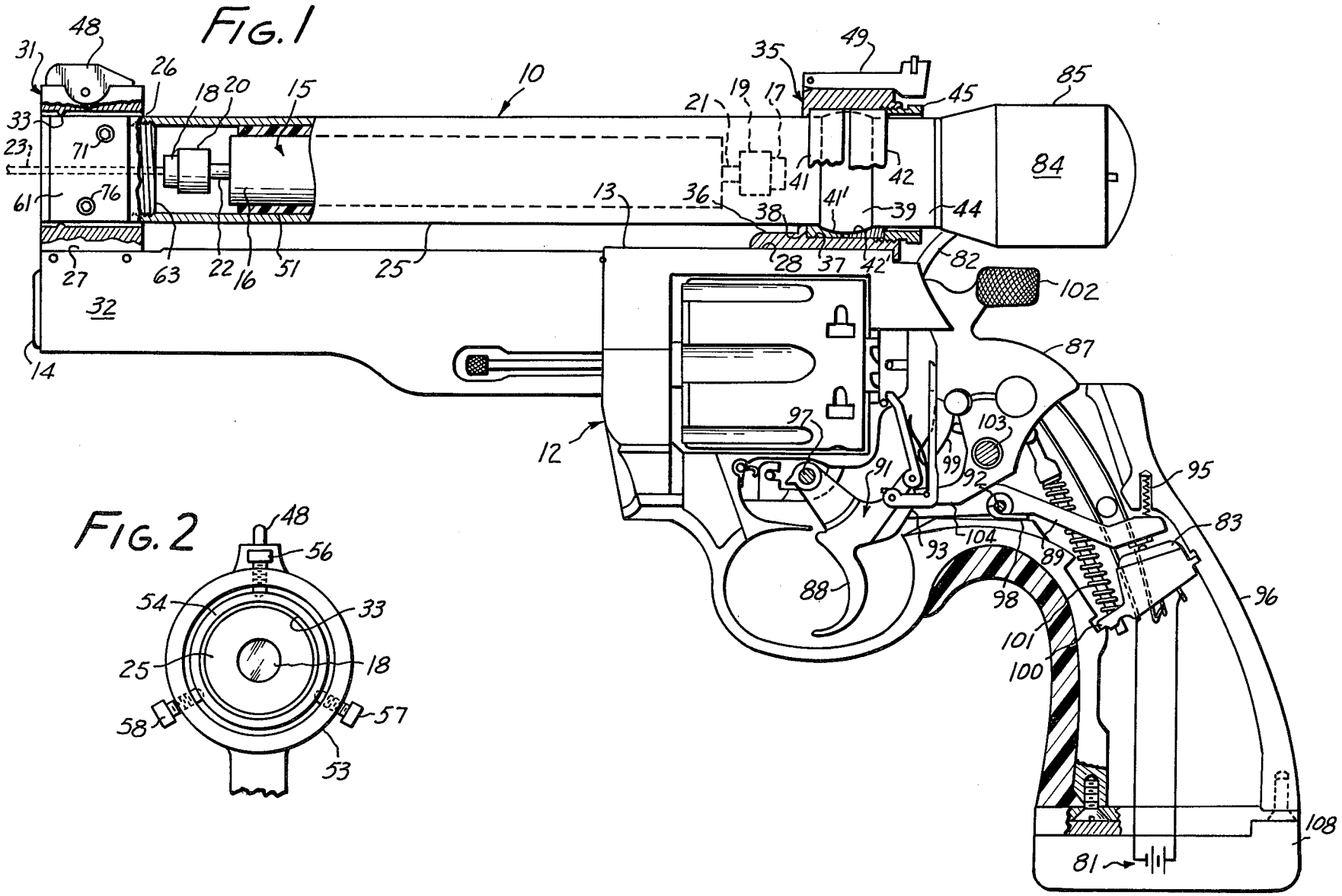
FIG. 1 is a side view, partially in section, of a firearm equipped with a laser beam aiming assistance system according to a preferred embodiment of the subject invention.
FIG. 2 is an elevation of equipment for adjusting the relative position of an aiming mark on a target, which may be employed in conjunction with the aiming assistance system according to FIG. 1, in accordance with a further embodiment of the subject invention.

In particular, the revolver 12 shown in FIG. 1 has a frame 13 and a barrel 14 threaded therein and projecting therefrom. The laser 15 employed in the illustrated preferred embodiment of the subject invention preferably is of the gas laser type. By way of example, a suitable laser is the helium-neon laser employing electrical glow discharge excitation.

Accordingly, the laser 15 comprises a laser tube 16 containing a helium-neon or other gaseous laser gain medium in an elongate optical cavity extending between end mirrors 17 and 18.

The expression "laser gain medium" is herein employed to designate the laser component which imparts optical regenerative gain to light traveling along the cavity of a laser action device. In this respect, the expression "laser action" is herein employed in preference to the familiar phrase "light amplification by stimulated emission of radiation," since the quantum device called "laser" more appropriately may have to be viewed as an oscillator, rather than a mere amplifier.

The end mirrors 17 and 18 are interconnected with the laser tube 16 and, in the illustrated preferred embodiment, are mounted at opposite ends of that tube. In particular, the tube 16 includes a first extension or nipple 19, in an end portion of which the mirror 17 is mounted. Similarly, the laseer tube 16 at its other end has an extension or nipple 20, in an end portion of which the mirror 18 is mounted. Reduced diameter neck portions 21 and 22 in the nipples 19 and 20 are bendable with a heavy screw driver or other appropriate tool to permit lateral adjustment or alignment of the end mirrors relative to the laser cavity in the tube 16 during manufacturing of the laseı 15.

The illustrated gas laser 15 is simple, rugged and reliable. However, it has to be kept in mind that effective laser action depends on a buildup of energy by repeated reflection of radiation between the end mirrors 17 and 18 through the gas fill or other laser gain medium in the optical cavity.

In practice, there are definite ways or modes in which radiation can go back and forth in the cavity or bore between the end mirrors prior to escaping as a high-energy coherent beam 23 through the end mirror 18.

In practice, thermal effects, occurring stresses and other operating conditions may engender an impairment of the mode during operation of the laser. Attempts to decrease such disturbances through an increase in optical cavity or bore diameter have not proved feasible, since a liberal cavity or bore width permits development of divergent modes or non-circularly-symmetrical mode-bore relationships. An oversized cavity diameter or bore also interferes with the requisite sustained population inversion generation and output/input efficiency. This is particularly important in the case of laser beam aiming assistance equipment which operates typically from a portable power source, such as a battery of limited capacity, and which should provide as bright an aiming mark as possible on targets located at a distance from the firearm.

The subject invention solves these problems and meets these desiterata by keeping longitudinal and transverse stresses and bending forces away from the laser 15, in a practically stress-free mounting.

The subject invention locates the laser 15 in a tubular member 25 for emission of the light beam 23 through an end 26 of the tubular member. The subject invention also mounts the tubular member 25 at a first location 27 with linear freedom of movement relative to the firearm. The invention also mounts the tubular member 25 at a second location 28 with angular freedom of movement relative to the firearm 12.

In the illustrated preferred embodiment of the subject invention, a tubular mounting member 31 is attached to the front of the barrel assembly 32 of the firearm, and provides a slip joint through which the tubular member 25 can expand or move linearly or axially without binding. This front mounting member includes a sleeve encompassing the tubular member and having an annular protrusion 33 which contacts the tubular member 25 along a circular line or narrow band. The front mounting member 31 thus restrains the tubular member 25 at the first location 27 against angular movement relative to a longitudinal axis of the tubular member or relative to the firearm barrel 14.

The rear mounting device 35 is spaced from the front mounting device 31 and has a tubular member attached to the frame 13 of the firearm via a foot 36. The mounting member 35 has a bore 37 bounded by shoulder portion 38.

The tubular member 25, on the other hand, has a spherical circular bulge 39 located about midway inside the bore 37 of the rear mounting member 35.

The circularly protruding part 39 of the tubular member 25 may be referred to as a ball mount. A pair of ball seat rings 41 and 42 are located in the bore 37 of the rear mounting device 35 and have internal spherical surfaces 41', 42' for accommodating the outer spherical surface of the annular protrusion 39 of the tubular member 25. A second end portion 44 of the tubular member 25 extends from the ball mount 39 through the ball seat ring 42 and through a retaining ring 45. The retaining ring 45 is threaded into the annular sleeve of the rear mounting member 35 for releasably retaining the ball seat rings 41 and 42 in the bore 37 of the rear mounting member 35 and for retaining these rings 41 and 42 in engagement at their internal spherical surfaces with the outer spherical surface of the annular protrusion 39. In this manner, the tubular member 25 is effectively restrained against linear or axial movement at the rear mounting member 35.

On the other hand, the rear mounting member 35, with its ball seat rings 41 and 42 pivots the tubular member 25 with its ball mount 39 for omnidirectional angular movement relative to the firearm 12 or its frame and barrel 13 and 14.

A combination of the subject invention so far discussed providing linear freedom of movement with restraint against angular movement at a first location while providing angular freedom of movement with restraint against linear movement at a second location, keeps longitudinal and transverse stresses generated by the firearm 13 through bending or heating away from the laser 15 in the tubular member 25. This advantage is particularly important in the case of firearms which develop considerable mechanical and thermal stresses during their operation.

In this manner, the laser device may be closely and compactly mounted on the firearm near the frame and barrel thereof and parallel thereof. This has the practical advantage of enabling the provision of a front sight 48 on the first laser tube mounting device 31 and a rear sight 49 on the second laser tube mounting device 35. In principle, the ball joint type of mount 35 could be provided at the front location 27, while the slip joint type of mount 31 could be provided at the second mounting location 28. However, the illustrated embodiment of the subject invention is presently preferred.

The mounting technique and equipment of the subject invention permits the tubular laser 15 to be rigidly mounted in the tubular member 25. For instance, the laser 15 may be potted directly in the tube 25. Suitable potting compounds, depending on desired thermal conductivity, operating temperatures and elasticity, include urethane elastomers, silicone rubber and other elastomeric potting compounds, epoxy resin, polyester resin and other resinous potting compounds. Upon insertion into the tubular member 25 and around the laser 15, the potting material either sets or is cured depending on the type of material employed.

The sleeve-like laser mounting structure 51 in the tubular member 25 thus may be part of a cured or set potting compound. Alternatively, one or two spaced mounting rings may be provided in the tubular member 25 for mounting the laser 15 relative thereto. At any rate, the prior-art anti-shock mounts with their guide tracks, coil springs and pneumatic dampener are advantageously avoided in the practice of the subject invention.

It may be recalled at this juncture that restraint of the tubular member 25 against angular movement at the first location 27 is a feature of the preferred embodiment illustrated in FIG. 1. This, however, does not within the broad scope of the subject invention, as presently perceived, mean that any angular adjustment of the tubular member at the first location 27 is necessarily out of the question. Rather, as illustrated in FIG. 2, such angular adjustment may be employed for the purpose of permitting adjustment of the relative position of the aiming mark provided by the laser 15 on the target of the firearm.

In particular, the front mounting member 31 may according to FIG. 2 be replaced by a sleeve-shaped member 53 which is mounted on the firearm 12 or on the barrel assembly 32 at the first location 27. The modified mounting member 53 has a bore sufficiently wide to accommodate an annular slip joint member 54, which has the above mentioned annular protrusion 33 for contacting the tubular member 25 along a circular line or narrow annular band. Three screws 56, 57 and 58 are threaded through the mounting member 53 for adjustably mounting or retaining the slip joint ring 54. For a rugged construction insensitive to inertial forces due to firing, the screws 56 to 58 may engage the slip joint ring 54 via flat screw tips or interface plates (not shown). The screws 56 to 58 are preferably located 120° apart. In this manner, selective tightening and relative loosening of the screws 56 to 58 permits the tubular member 25 to be angularly adjusted, particularly for an adjustment of the laser beam 23 relative to the boresight of the firearm.

In this respect, and in general, the aiming assistance system herein disclosed may broadly be considered as including first means 39 on the tubular member 25 having a surface curved at a radius in a plane intersecting the firearm and the tubular member longitudinally, such as along an axis of symmetry of the barrel 14. The mounting member 35 may then be considered as including second means 41 and 42 engaging the first means 39 at a surface or surfaces 41', 42' complementary to the curved surface of the first means 39. The sleeve-like member of the mounting device 35, with its foot 36, may then be considered as means for coupling the second means 41 and 42 to the firearm. The first and second means just mentioned may within the broad scope of the subject invention be realized by mounting devices having, for instance, cylindrical, rather than necessarily spherical surfaces.

In a similar manner, the other mounting device 31 may be considered as a third means for mounting the tubular member 25 on the firearm at a distance from the means 35 and engaging the tubular member for restricting such member 25 to linear motion relative to the third means.

These third means just mentioned with reference to FIG. 1, or their modified counterpart shown in FIG. 2, include a sleeve 31 or 54 encompassing the tubular member 25 and having an annular protrusion 33 contacting that tubular member or a tubular extension thereof.

According to the principles disclosed with reference to FIG. 2, the relative position of the light spot provided by the laser beam 23 on a target of the firearm, may then be adjusted by effecting relative movement between the pair of complementary surfaces provided by the protrusion 39 of the tubular member 25 and either of the ball seat rings 41 and 42. The device shown in FIG. 2 may, by way of example, constitute a means for effecting such relevant movement in the mounting device 35.

Alternatively, the laser beam 23 may be selectively deflected for adjusting the relative position of the light spot or aiming mark provided by the laser beam 23.

To this end, an optical beam deflecting device 61 may, for instance, be provided at the front end of the tubular member 25 in the front end mounting device 31.

Figure 3:
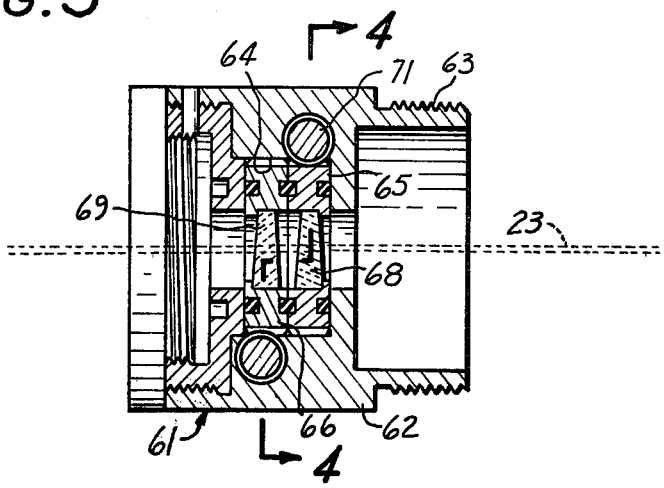
FIG. 3 is a longitudinal section through optical equipment for adjusting the relative position of an aiming mark on a target, which may be employed in conjunction with the laser beam aiming assistance system of FIG. 1, in accordance with a further embodiment of the subject invention.
Figure 4:
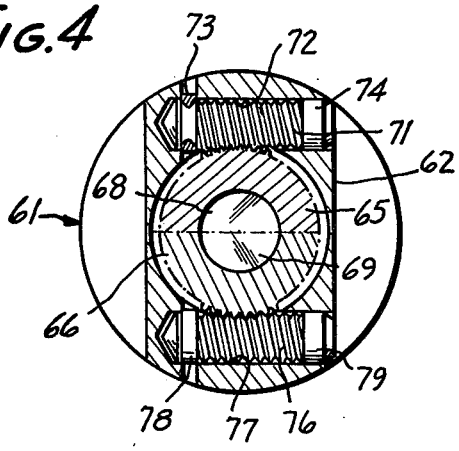
FIG. 4 is a section along the line 4—4 of FIG. 3.

The optical beam deflecting device 61 shown in more detail in FIGS. 3 and 4 borrows a page from the so-called Risley or Herschel prism used by ophthalmologists in measuring binocular accommodation [see Jenkins and White, FUNDAMENTALS OF OPTICS (McGraw-Hill, 3rd Edition 1957) pp. 23, 24, FIG. 2L(b), (c)] and used also in the design of variable deviation wedges for checking scale factors of angular reading devices, such as collimators and rotary tables, or for any application where light deviation is required through a known angle.

In particular, the adjustable deflecting device 61 shown in FIGS. 3 and 4 has a cylindrical housing 62 provided with a threaded nipple 63 for threaded union with the tubular member 25. The housing 62 may thus be considered an extension or end portion of the tubular member 25, whereby the statement that the mounting device 31 engages with its internal circular protrusion 33 the tubular member 25 also applies to the case shown in FIG. 1 where such engagement takes place via the deflecting device 61 extending from or as an end portion of the tubular member 25.

The housing 63 has a bore or cylindrical cavity 64 accommodating gears 65 and 66.

The gear 65 houses a prism 68 for rotation therewith. Similarly, the gear 66 houses a prism 69 for rotation therewith. A worm drive screw 71 extends in a bore 72 of the housing and is retained therein by a spring clip 73. The worm drive screw 71 meshes with the gear 65 for rotation of that gear 65 and its prism 68, upon rotation of the drive screw 71 with an appropriate tool, such as a hexagonal wrench, received in a corresponding head or socket 74.

Similarly, a worm drive screw 76 extends in a bore 77 in the housing 62 and is retained therein by a spring clip 78. The drive screw is rotatable by a suitable wrench via a corresponding head 79, and meshes with the gear 66 in order to rotate that gear and the prism 69 contained therein.

The prisms 68 and 69 are wedge-shaped. Also, all air/glass interfaces of the prisms 68 and 69 are tilted relative to a perpendicular plane through the laser beam 23 emitted by the laser 15, so as to avoid reflection of any significant laser energy to the laser end mirror 18. This is an important feature, since the formation of any dual or ghost aiming marks in addition to the desired aiming mark would confuse the user of the firearm and is, therefore, strictly to be avoided. For the same reason, the prisms are preferably provided with anti-reflective coatings, so that each prism surface preferably has a reflection not exceeding one percent.

The two prisms 68 and 69 are independently rotatable via drive screws 71 and 76. The prisms are preferably geometrically identical, whereby one prism may be rotated so as to cancel the wedge effect of the other, as desired or necessary.

By relative adjustment of the two prisms 68 and 69, the aiming mark produced by the laser beam 23 on a target of the firearm may be adjusted, such as relative to a longitudinal axis through the barrel 14, within a circular area havng a radius equal to twice the amount of deviation or beam deflection obtainable with the prism 68 alone.

Unlike mechanical adjustments, the optical adjustment effected by the unit 61 is shockproof and synergistically combines with the tubular member 25 and its mount at 31 and 35, since the optical adjustment effected by the unit 61 in the context of a firearm would be useless without the stress-relieving mounts at 31 and 35, and since feasibility and utility of such combination of mounts are enhanced by the facility of the type of optical beam deflection adjustability shown in FIGS. 3 and 4.

The laser 15 preferably is energized from a portable power source, such as a battery 81 which is connectable to a feed cable 82 via a switch 83. The feed cable 82 leads to a ballast assembly 84 which has a housing 85 forming an end portion of, or being attached to end 44, of the tubular member 25. The ballast 84, in a manner known per se in laser technology, provides upon connection to the battery 81 upon closure of the switch 83 the requisite high voltage potential between the anode and cathode of the laser 15 for a pumping thereof.

If the laser 15 is a gas laser, then the energized ballast 85 will electrically pump or excite the gaseous laser gas medium by means of an electrical gas discharge in the laser cavity. As in other types of lasers, spatial and temporal coherence arises from the regenerative character of the combined laser gain medium and optical cavity.

In this process, radiation of light travels back and fourth between the end mirrors 17 and 18 in definite ways or modes. The rear end mirror 17 is a highly reflective mirror, while the front end mirror 18 is partially transmissive, so that the luminous laser output proceeds via mirror 18 in the form of a laser beam 23.

While the reduced diameter neck portions 21 and 22 have been described above as bendable for adjustment purposes, it should be recognized that the laser tube 16 with extensions 19 and 20 is in fact bendable, even if made of glass or a ceramic or if composed of a metal-ceramic structure. By the same token, the end mirrors 17 and 18 are tiltable, typically in opposite senses, be it by virtue of their attachment to opposite ends of the laser tube via nipples 19 and 20 or by virtue of their coupling to the supporting structure at 51.

In the light of these facts, the importance and great utility of the practically stress-free laser mounting methods and equipment according to the subject invention become emphatically apparent. At the same time, the laser assembly and mounting structure resulting from the practice of the subject invention is simple, rugged and unobtrusive to an extent heretofore unparalleled in the laser beam aiming assistance field employing the more powerful gas laser.

The laser 15 in the aiming device 10 is actuated for provision of an aiming mark prior to any release of the hammer 87 from a manually cocked position and prior to any other actuation of the hammer by the manually squeezed finger trigger 88.

To this end, a switch-actuating lever 89 extends from the trigger assembly 91 to the power supply switch 83 and is pivoted for angular movement about a pin 92. The trigger assembly 91 has a cam surface 93 engageable with a first end of the pivoted lever 89. In the rest position of the finger trigger 88 shown in FIG. 1, the trigger assembly 91 engages the adjacent end portion of the lever 89 via its cam surface 93 and thus maintains the lever 89 in its extreme angular position against the bias of a spring 95 inserted in and projecting from the stock 96 of the firearm or from a frame portion at such stock.

The power supply switch 83 is of a normally open type, having a spring-biased actuator or plunger projecting from the switch proper in the open condition of the switch. Accordingly, the power supply switch 83 is maintained open, and the power supply source or battery 81 is thus maintained disconnected from the laser device and ballast assembly 84, in the quiescent condition of the firearm. To ths end, the bias of the trigger return spring 98 acts via trigger assembly 91 and cam surface 93 to maintain the pivoted lever 89 against the bias of the spring 95 away from the switch 83.

As soon as the trigger assembly 91 is being moved counterclockwise about the pivot 97 as seen in FIG. 1, closure of the switch 83 is initiated. For instance, the user of the firearm may manually move the trigger 88 and trigger assembly 91 with his trigger finger relative to the frame 13 and hammer 87. This quickly lifts the cam surface 93 off the lever 89 well before the trigger assembly 91 engages and moves the hammer 87 via its strut 99. The lever 89 is thus immediately swung clockwise as seen in FIG. 1 by the bias of the spring 95, and thereby depresses the plunger of the power supply switch 83 at the main spring seat 100 for a closure of switch 83. This connects the ballast and high-voltage assembly 84 to the power supply or battery 81. Accordingly, the laser 15 in the aiming device 10 is immediately activated and emits a laser beam 23 which provides the desired aiming mark on the target of the firearm well prior to the firing of any bullet or, for that matter, without necessity of any firing at all, if not desired at the time.

In case firing of the revolver 12 becomes necessary after provision of the aiming mark by the laser beam 23, the marksman may squeeze the trigger 88 further, whereupon the trigger assembly will engage the strut 99 and will actuate the hammer 87 only after activation of the aiming device 10 and provision of the aiming mark.

Sometimes it is desirable or necessary that the firearm be readied for very quick action. Such situations arise, for instance, frequently in law enforcement work where police officers are subjected to imminent danger. In that case, the officer may manually cock the hammer 87 against the bias of the main spring 101 through manual engagement of a grip plate or hammer spur 102 and angular movement of the hammer in a clockwise direction as seen in FIG. 1 about the pivot pin 103.

The lower extension 104 of the hammer 87 thus engages and rides on top of the trigger assembly 91, thereby moving the trigger assembly and its cam surface 93 away from the lever 89. This, in turn, permits the bias spring 95 to angularly move the lever 89 clockwise as seen in FIG. 1 and to thus close the power supply switch 83 and activate the aiming device 10 in response to a cocking of the hammer 87.

The battery 81 or a housing thereof may be structured as a butt end portion 108 of the firearm stock 96.

The subject invention and its various aspects and embodiments thus meet all the above mentioned objectives and provide firearms and aiming assistance devices that are particularly suited to the needs of law enforcement work, and that avoid the many drawbacks of prior-art proposals.

The subject extensive disclosure will suggest and render apparent to those skilled in the art various modifications and variations within the spirit and scope of the subject invention.

I claim:

1. In a method of assisting the aiming of a firearm with a light beam from a laser, the improvement comprising in combination the steps of:

locating said laser in a tubular member for emission of said light beam through an end of said tubular member;

mounting said tubular member at a first location with only linear freedom of movement relative to said firearm; and mounting said tubular member at a second location with only angular freedom of movement relative to said firearm.

2. A method as claimed in claim 1, including the step of:

restraining said tubular member at said first location against angular movement relative to a longitudinal axis of said tubular member.

3. A method as claimed in claim 1, including the step of:

restraining said tubular member at said second location against linear movement.

4. A method as claimed in claim 1, including the step of:

pivoting said tubular member at said second location.

5. A method as claimed in claim 1, including the step of:

pivoting said tubular member at said second location for omnidirectional angular movement.

6. A method as claimed in claim 1, including the steps of:

restraining said tubular member at said first location against angular movement relative to a longitudinal axis of said tubular member; and restraining said tubular member at said second location against linear movement.

7. A method as claimed in claim 1, including the steps of:

restraining said tubular member at said first location against angular movement relative to a longitudinal axis of said tubular member; and pivoting said tubular member at said second location.

8. A method as claimed in claim 1, including the steps of:

restraining said tubular member at said first location against angular movement relative to a longitudinal axis of said tubular member; and pivoting said tubular member at said second location for omnidirectional angular movement.

9. A method as claimed in claim 1, 2, 3, 4, 5, 6, 7 or 8, including the step of:

providing a sight for said firearm at one of said first and second locations.

10. A method as claimed in claim 1, 2, 3, 4, 5, 6, 7 or 8, including the steps of:

providing a front sight for said firearm at one of said first and second locations; and providing a rear sight for said firearm at the other of said first and second locations.

11. A method as claimed in claim 1, 2, 3, 4, 5, 6, 7 or 8, including the step of:

rigidly mounting said laser in said tubular member.

12. A method as claimed in claim 1, 2, 3, 4, 5, 6, 7 or 8, including the step of:

potting said laser in said tubular member.

13. A method as claimed in claim 1, 3, 4 or 5, including the step of:

providing for angular adjustment of said tubular member at said first location.

14. A method as claimed in claim 1, 2, 3 4, 5, 6, 7 or 8, including the step of:

optically deflecting said light beam at said end of the tubular member.

15. In apparatus for assisting the aiming of a firearm, the improvement comprising in combination:

a tubular member;

means for providing an aiming mark on a target of said firearm including a laser mounted in said tubular member for emitting a light beam through an end of said tubular member;

means for mounting said tubular member on said firearm at a first location, including means for providing said tubular member with only linear freedom of movement relative to said firearm; and means for mounting said tubular member on said firearm at a second location, including means for providing said tubular member with only angular freedom of movement relative to said firearm.

16. Apparatus as claimed in claim 15, wherein:

said means for mounting said tubular member at a first location include means for restraining said tubular member against angular movement relative to a longitudinal axis of said tubular member.

17. Apparatus as claimed in claim 15, wherein:

said means for mounting said tubular member at a second location include means for restraining said tubular member against linear movement.

18. Apparatus as claimed in claim 15, wherein:

said means for mounting said tubular member at a first location include means for restraining said tubular member against angular movement relative to a longitudinal axis of said tubular member; and said means for mounting said tubular member at a second location include means for restraining said tubular member against linear movement.

19. Apparatus as claimed in claim 15, wherein:

said means for mounting said tubular member at a second location include means for pivoting said tubular member.

20. Apparatus as claimed in claim 15, wherein:

said means for mounting said tubular member at a second location include means for omnidirectionally pivoting said tubular member.

21. Apparatus as claimed in claim 15, wherein:

said means for mounting said tubular member at a second location include a ball joint.

22. Apparatus as claimed in claim 21, wherein:

said means for mounting said tubular member at a first location include a sleeve encompassing said tubular member.

23. Apparatus as claimed in claim 21, wherein:

said means for mounting said tubular member at a first location include a sleeve having an annular protrusion contacting said tubular member.

24. Apparatus as claimed in claim 15, including:

a sight for said firearm on one of said mounting means.

25. Apparatus as claimed in claim 15, including:

a front sight for said firearm at one of said mounting means; and a rear sight for said firearm at the other of said mounting means.

26. Apparatus as claimed in claim 15, 16, 17, 18, 19, 20, 21, 22, 23, 24 or 25, including:

rigid means for rigidly mounting said laser in said tubular member.

27. Apparatus as claimed in claim 15, 16, 17, 18, 19, 20, 21, 22, 23, 24 or 25, wherein:

said laser is potted in said tubular member.

28. Apparatus as claimed in claim 15, 16, 17, 18, 19, 20, 21, 22, 23, 24 or 25, wherein:

said means for mounting said tubular member at a first location include means for angularly adjusting said tubular member.

29. Apparatus as claimed in claim 15, 16, 17, 18, 19, 20, 21, 22, 23, 24 or 25, including:

means at said end of the tubular member for deflecting said light beam.

30. In apparatus for assisting the aiming of a firearm, the improvement comprising in combination:

means for providing an aiming mark in the form of a light spot on a target, including a laser device for emitting a laser beam to said target;

means including a tubular member for housing said laser device; and means for mounting said tubular member on said firearm, including first means on said tubular member having a surface curved at a radius in a plane intersecting said firearm and said tubular member longitudinally, and second means engaging said first means at a surface accommodating said curved surface, and means for coupling said second means to said firearm.

31. Apparatus as claimed in claim 30, wherein:

said mounting means include third means for mounting said tubular member on said firearm at a distance from said first and second means.

32. Apparatus as claimed in claim 31, wherein:
said third means include means engaging said tubular member for restricting said tubular member to linear motion relative to said third means.

33. Apparatus as claimed in claim 31, wherein:
said third means include a sleeve encompassing said tubular member.

34. Apparatus as claimed in claim 31, wherein:
said third means include a sleeve having an annular protrusion contacting said tubular member.

35. Apparatus as claimed in claim 30, 31 or 32, including:
a sight for said firearm on said second means.

36. Apparatus as claimed in claim 31 or 32, including:
a front sight for said firearm on one of said second and third means; and
a rear sight for said firearm on the other of said second and third means.

37. Apparatus as claimed in claim 30 or 31, including:
means connected to said tubular member for adjusting the relative position of said light spot.

38. Apparatus as claimed in claim 37, wherein:
said adjusting means include means for effecting relative movement between said curved accommodating surfaces.

39. Apparatus as claimed in claim 37, wherein:
said adjusting means include means for selectively deflecting said laser beam.

40. Apparatus as claimed in claim 30, 31, 32, 33 or 34, wherein:
said second means engage said first means at a surface complementary to said curved surface.

41. In a method of assisting the aiming of a firearm with a light beam from a laser, the improvement comprising in combination the steps of:
locating said laser in a tubular member for emission of said light beam through an end of said tubular member;
mounting said tubular member at a first location with linear freedom of movement relative to said firearm;
mounting said tubular member at a second location with angular freedom of movement relative to said firearm; and
providing a sight for said firearm at one of said first and second locations.

42. A method as claimed in claim 41, including the steps of:
providing said sight as a front sight for said firearm at said one of said first and second locations; and
providing a rear sight for said firearm at the other of said first and second locations.

43. In a method of assisting the aiming of a firearm with a light beam from a laser, the improvement comprising in combination the steps of:
potting said laser in a tubular member for emission of said light beam through an end of said tubular member;
mounting said tubular member at a first location with linear freedom of movement relative to said firearm; and
mounting said tubular member at a second location with angular freedom of movement relative to said firearm.

44. A method as claimed in claim 41, 42 or 43, including the step of:
restraining said tubular member at said first location against angular movement relative to a longitudinal axis of said tubular member.

45. A method as claimed in claim 41, 42 or 43, including the step of:
restraining said tubular member at said second location against linear movement.

46. A method as claimed in claim 41, 42 or 43, including the step of:
pivoting said tubular member at said second location.

47. A method as claimed in claim 41, 42 or 43, including the step of:
providing for angular adjustment of said tubular member at said first location.

48. A method as claimed in claim 41, 42 or 43, including the step of:
optically deflecting said light beam at said end of the tubular member.

49. In apparatus for assisting the aiming of a firearm, the improvement comprising in combination:
a tubular member;
means for providing an aiming mark on a target of said firearm including a laser mounted in said tubular member for emitting a light beam through an end of said tubular member;
means for mounting said tubular member on said firearm at a first location, including means for providing said tubular member with linear freedom of movement relative to said firearm; and
means for mounting said tubular member on said firearm at a second location, including ball joint means for providing said tubular member with angular freedom of movement relative to said firearm.

50. In apparatus for assisting the aiming of a firearm, the improvement comprising in combination:
a tubular member;
means for providing an aiming mark on a target of said firearm including a laser mounted in said tubular member for emitting a light beam through an end of said tubular member;
means for mounting said tubular member on said firearm at a first location, including a sleeve encompassing said tubular member for providing said tubular member with linear freedom of movement relative to said firearm; and
means for mounting said tubular member on said firearm at a second location, including means for providing said tubular member with angular freedom of movement relative to said firearm.

51. Apparatus as claimed in claim 50, wherein:
said sleeve has a protrusion contacting said tubular member.

52. In apparatus for assisting the aiming of a firearm, the improvement comprising in combination:
a tubular member;
means for providing an aiming mark on a target of said firearm including a laser mounted in said tubular member for emitting a light beam through an end of said tubular member;
means for mounting said tubular member on said firearm at a first location, including means for providing said tubular member with linear freedom of movement relative to said firearm;
means for mounting said tubular member on said firearm at a second location, including means for providing said tubular member with angular freedom of movement relative to said firearm; and a sight for said firearm on one of said mounting means.

53. Apparatus as claimed in claim 52, including:

said sight as a front sight for said firearm at said one of said mounting means; and including a rear sight for said firearm at the other of said mounting means.

54. In apparatus for assisting the aiming of a firearm, the improvement comprising in combination:

a tubular member;

means for providing an aiming mark on a target of said firearm including a laser rigidly mounted in said tubular member for emitting a light beam through an end of said tubular member;

means for mounting said tubular member on said firearm at a first location, including means for providing said tubular member with only linear freedom of movement relative to said firearm; and means for mounting said tubular member on said firearm at a second location, including means for providing said tubular member with angular freedom of movement relative to said firearm.

55. In apparatus for assisting the aiming of a firearm, the improvement comprising in combination:

a tubular member;

means for providing an aiming mark on a target of said firearm including a laser potted in said tubular member for emitting a light beam through an end of said tubular member;

means for mounting said tubular member on said firearm at a first location, including means for providing said tubular member with linear freedom of movement relative to said firearm; and means for mounting said tubular member on said firearm at a second location, including means for providing said tubular member with angular freedom of movement relative to said firearm.

56. In apparatus for assisting the aiming of a firearm, the improvement comprising in combination:

a tubular member;

means for providing an aiming mark on a target of said firearm including a laser mounted in said tubular member for emitting a light beam through an end of said tubular member;

means for mounting said tubular member on said firearm at a first location, including means for providing said tubular member with only linear freedom of movement relative to said firearm and means for angularly adjusting said tubular member; and means for mounting said tubular member on said firearm at a second location, including means for providing said tubular member with angular freedom of movement relative to said firearm.

57. In apparatus for assisting the aiming of a firearm, the improvement comprising in combination:

a tubular member;

means for providing an aiming mark on a target of said firearm including a laser mounted in said tubular member for emitting a light beam through an end of said tubular member;

means for mounting said tubular member on said firearm at a first location, including means for providing said tubular member with linear freedom of movement relative to said firearm;

means for mounting said tubular member on said firearm at a second location, including means for providing said tubular member with angular freedom of movement relative to said firearm; and means at said end of the tubular member for subjecting said light beam to optical deflection, including means for selectively adjusting a relative position of said aiming mark.

58. Apparatus as claimed in claim 50, 51, 52, 53, 54, 55, 56 or 57, wherein:

said means for mounting said tubular member at a first location include means for restraining said tubular member against angular movement relative to a longitudinal axis of said tubular member.

59. Apparatus as claimed in claim 50, 51, 52, 53, 54, 55, 56 or 57, wherein:

said means for mounting said tubular member at a second location include means for restraining said tubular member against linear movement.

60. Apparatus as claimed in claim 50, 51, 52, 53, 54, 55, 56 or 57, wherein:

said means for mounting said tubular member at a first location include means for restraining said tubular member against angular movement relative to a longitudinal axis of said tubular member; and said means for mounting said tubular member at a second location include means for restraining said tubular member against linear movement.

61. Apparatus as claimed in claim 50, 51, 52, 53, 54, 55, 56 or 57, wherein:

said means for mounting said tubular member at a second location include means for pivoting said tubular member.

62. In a method of assisting the aiming of a firearm with a light beam from a laser, the improvement comprising in combination the steps of:

locating said laser in a tubular member for emission of said light beam through an end of said tubular member;

mounting said tubular member at a first location with linear freedom of movement relative to said firearm and restraining said tubular member at said first location against angular movement relative to a longitudinal axis of said tubular member; and mounting said tubular member at a second location with angular freedom of movement relative to said firearm.

63. A method as claimed in claim 62, including the step of:

restraining said tubular member at said second location against linear movement.

64. A method as claimed in claim 62, including the step of:

pivoting said tubular member at said second location.

65. A method as claimed in claim 62, including the step of:

pivoting said tubular member at said second location for omnidirectional angular movement.

66. A method as claimed in claim 62, 63, 64 or 65, including the step of:

providing a sight for said firearm at one of said first and second locations.

67. A method as claimed in claim 62, 63, 64 or 65, including the steps of:

providing a front sight for said firearm at one of said first and second locations; and providing a rear sight for said firearm at the other of said first and second locations.

68. A method as claimed in claim 62, 63, 64 or 65, including the step of:

rigidly mounting said laser in said tubular member.

69. A method as claimed in claim 62, 63, 64 or 65, including the step of:

potting said laser in said tubular member.

70. A method as claimed in claim 62, 63, 64 or 65, including the step of:

providing for angular adjustment of said tubular member at said first location.

71. A method as claimed in claim 62, 63, 64 or 65, including the step of:

optically deflecting said light beam at said end of the tubular member.

72. In apparatus for assisting the aiming of a firearm, the improvement comprising in combination:

a tubular member;

means for providing an aiming mark on a target of said firearm including a laser mounted in said tubular member for emitting a light beam through an end of said tubular member;

means for mounting said tubular member on said firearm at a first location, including means for providing said tubular member with linear freedom of movement relative to said firearm and for restraining said tubular member against angular movement relative to a longitudinal axis of said tubular member; and means for mounting said tubular member on said firearm at a second location, including means for providing said tubular member with angular freedom of movement relative to said firearm.

73. Apparatus as claimed in claim 72, wherein:

said means for mounting said tubular member at a second location include means for restraining said tubular member against linear movement.

74. Apparatus as claimed in claim 72, wherein:

said means for mounting said tubular member at a second location include means for pivoting said tubular member.

75. Apparatus as claimed in claim 72, wherein:

said means for mounting said tubular member at a second location include means for omnidirectionally pivoting said tubular member.

76. Apparatus as claimed in claim 72, wherein:

said means for mounting said tubular member at a second location include a ball joint.

77. Apparatus as claimed in claim 72, wherein:

said means for mounting said tubular member at a first location include a sleeve encompassing said tubular member and protruding into contact with said tubular member.

78. Apparatus as claimed in claim 72, wherein:

said means for mounting said tubular member at a first location include a sleeve having an annular protrusion contacting said tubular member.

79. Apparatus as claimed in claim 72, including:

a sight for said firearm on one of said mounting means.

80. Apparatus as claimed in claim 72, including:

a front sight for said firearm at one of said mounting means; and a rear sight for said firearm at the other of said mounting means.

81. Apparatus as claimed in claim 72, 73, 74, 75, 76, 77, 78, 79 or 80, including:

rigid means for rigidly mounting said laser in said tubular member.

82. Apparatus as claimed in claim 72, 73, 74, 75, 76, 77, 78, 79 or 80, including:

a sleeve-like laser mounting structure between said laser and an inside of said tubular member for mounting said laser in said tubular member.

83. Apparatus as claimed in claim 72, 73, 74, 75, 76, 77, 78, 79 or 80, wherein:

said laser is potted in said tubular member.

84. Apparatus as claimed in claim 72, 73, 74, 75, 76, 77, 78, 79 or 80, wherein:

said means for mounting said tubular member at a first location include means for angularly adjusting said tubular member.

85. Apparatus as claimed in claim 72, 73, 74, 75, 76, 77, 78, 79 or 80, including:

means at said end of the tubular member for deflecting said light beam.

* * * * *